United States Patent [19]

Barber

[11] 3,947,041

[45] Mar. 30, 1976

[54] GOLF CLUB

[76] Inventor: Jerry Barber, P.O. Box 550, La Canada, Calif. 91011

[22] Filed: Dec. 10, 1973

[21] Appl. No.: 423,062

[52] U.S. Cl. ..... 273/167 G
[51] Int. Cl.[2] ..... A63B 53/04
[58] Field of Search 273/80 C, 77 R, 164, 167–175, 273/80.2–80.8

[56] References Cited

UNITED STATES PATENTS

| | | | |
|---|---|---|---|
| 1,550,501 | 8/1925 | Byrne | 273/167 G |
| 2,683,036 | 7/1954 | Klein | 273/167 G |
| 2,784,969 | 3/1957 | Brandon | 273/80 C X |
| 3,020,048 | 2/1962 | Carroll | 273/167 G |
| 3,194,564 | 7/1965 | Swan | 273/80 C X |
| 3,655,188 | 4/1972 | Solheim | 273/80 C X |
| D94,111 | 12/1934 | Bernardi | D34/5 GH |
| D181,813 | 12/1957 | Rood | 273/167 J UX |
| D190,035 | 4/1961 | Hansen | 273/167 J X |
| D197,471 | 2/1964 | Handelan | 273/80 C UX |
| D222,280 | 10/1971 | Cook | 273/167 J X |

FOREIGN PATENTS OR APPLICATIONS

| | | | |
|---|---|---|---|
| 6,682 | 4/1891 | United Kingdom | 273/80 C |
| 4,810 | 3/1896 | United Kingdom | 273/80 C |
| 5,739 | 3/1910 | United Kingdom | 273/167 J |
| 465,652 | 5/1937 | United Kingdom | 273/80 C |

OTHER PUBLICATIONS

"Golf World"; Feb. 23, 1971; p. 27.
"Golf World"; Apr. 13, 1973; p. 42.

*Primary Examiner*—Richard J. Apley
*Attorney, Agent, or Firm*—Christie, Parker & Hale

[57] ABSTRACT

A golf club iron in which the hosel connects to the club head at one side of the top line of the head rather than along the side and base. The surfaces of the hosel and the bridging portion between the hosel and club head which face the line of flight from the face of the club are essentially flattened and continuous with the hitting surface of the club face. The combination of these structural relationships results in a club which is non-shanking.

7 Claims, 6 Drawing Figures

14
15
24
12
6
23
19
7
18
21
17
11
26
2
3
4
16
10
20
22

GOLF CLUB

DESCRIPTION OF THE PRIOR ART

The present invention relates to golf club irons and in particular to irons in which the risk of shanking is essentially eliminated and the hitting area of the club face is substantially increased.

In the conventional design of golf club irons, the portion of the golf club head extending between the shaft and the club face, called the hosel, is typically a rounded member of essentially uniform diameter which at one end is telescopically engaged with the shaft of the club and at the other end is integrally formed with the club head itself. According to the conventional design, the club head is positioned relative to the shaft such that the center line of the club shaft is located on a line which intersects with or is located to the rear of the line defining the top edge of the club face. This places the shaft a substantial distance behind the leading edge of the club face (the line defined by the sole of the club). In addition, the junction between the club head and the hosel typically extends along the entire length of one side (the fixed side) of the club head. Thus, the hosel extends from the sole to the top line of the club face and thence further upward to receive the shaft.

The net effect of these structural limitations is to provide an angular area at the heel of the club which defines an approximately 90° corner. When the club is swung such that the club face descends toward the ball slightly outside the intended line of flight, this corner area comes into contact with the ball and causes the ball to fly off at an angle with respect to the intended line of flight, producing "shanking."

SUMMARY OF THE PRESENT INVENTION

The present invention provides a non-shanking golf club iron. The invention comprises a golf club head of a generally elongated configuration with an upper and lower edge extending in the direction of elongation, said head having a club face, a hosel portion and bridging portion integrally connecting the head and the hosel portion. The bridging portion connects to the club head at one side of the upper edge of the club head. The bridging portion and hosel portion present in their golf ball contacting surfaces an essentially flat surface, said flat surface facing in the same direction as the club face and being continuous with the surface of the club face. In a further aspect of the invention, the club face is positioned with respect to the hosel and shaft such that an extension of the center line of the shaft intersects the lower half of the club face.

The net result of all of the foregoing modifications is to provide a golf club with an enlarged hitting area and with which it is virtually impossible to shank, since even if the ball is struck at or near the heel of the club the surface of the hosel or bridging portion coming in contact with the ball is flattened and faces in the same direction as the hitting area of the club face. Thus the ball is still driven along the intended line of flight even though a conventional "shank" has been made. The possibility of even striking the ball with these portions of the club is reduced by virtue of the location of the point of junction of the hosel at the top edge of the club head and the angle of the hosel which locates the club face such that the lower half of the club face aligns with the center line of the shaft.

DESCRIPTION OF THE DRAWINGS

These and other advantages of the invention will be better understood by reference to the figures of the drawing wherein.

DESCRIPTION OF THE SPECIFIC EMBODIMENT

Figures 1, 2, 3, 4, 5, 6, 7:
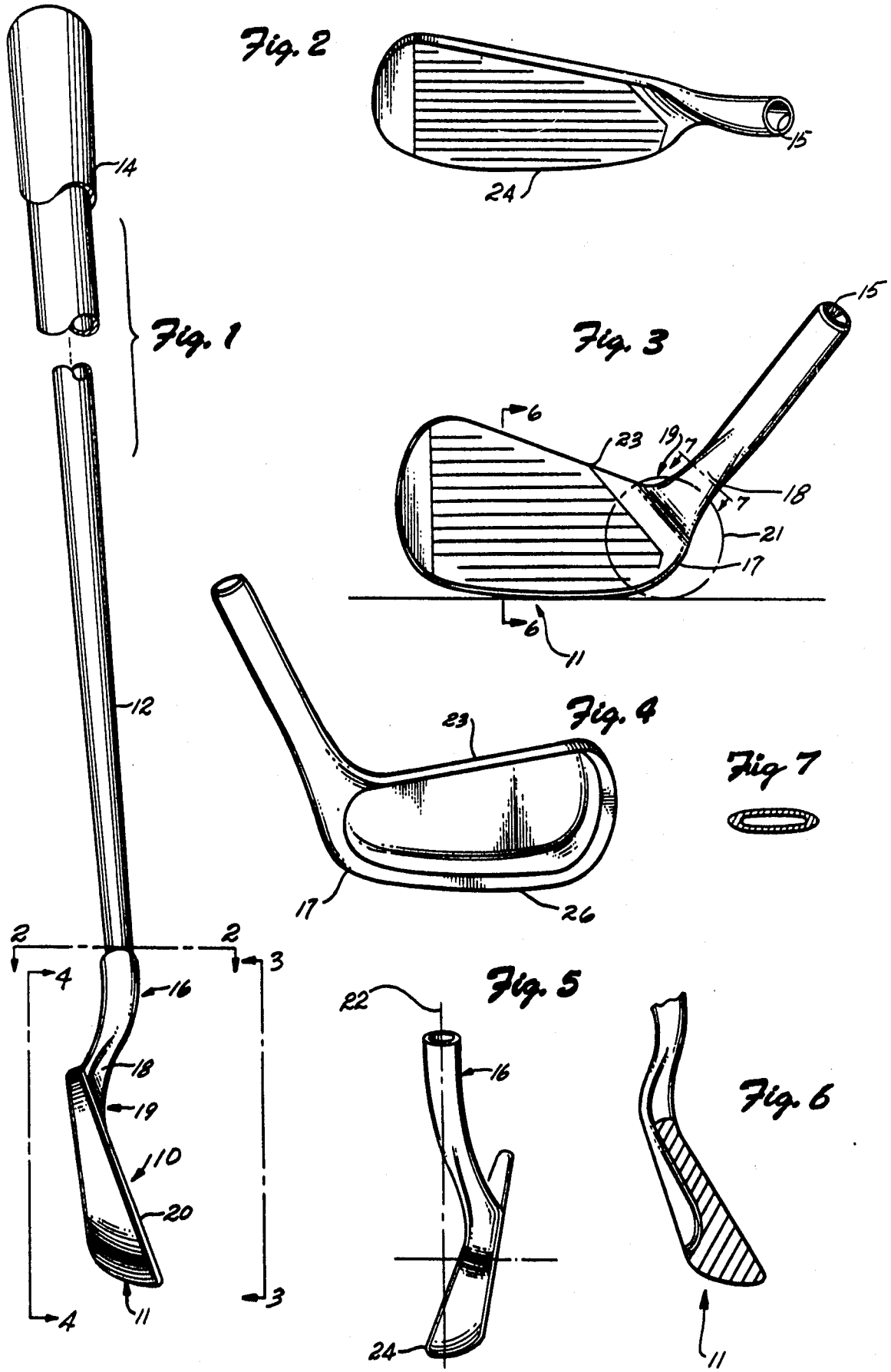
FIG. 1 is an elevation view of a golf club according to the present invention, including the club head, shaft, and grip.
FIG. 2 is a plan view of the club head taken along lines 2—2 of FIG. 1.
FIG. 3 is a front elevation view of the club head taken along lines 3—3 of FIG. 1.
FIG. 4 is a rear elevation view of the club head taken along lines 4—4 of FIG. 1.
FIG. 5 is a side elevation view of the club head taken from the shaft side of the club head.
FIG. 6 is a section view of the club head taken along lines 6—6 of FIG. 3.

Referring now to FIG. 1, the present invention comprises a golf club having a head 10, a club face 20, a sole portion 11 and a shank or hosel portion 16 connected by a bridging portion 19 to the head and extending upward from the club face in the direction generally perpendicular to the sole 11 of the club. A club shaft 12 having a grip 14 at one end is inserted at its opposite end into a hollowed out portion 15 at the upper end of the hosel. It will be understood that the description herein and the accompanying figures of the drawing, while referring to and depicting a right-handed club apply equally to left-handed clubs, the relative positioning and location of elements and portions thereof simply being reversed from that which is shown herein.

As is shown in the drawing, the lower end of the hosel is integrally formed with a bridging portion 19 which in turn is integrally formed with the club head. The bridging portion 19 and lower end of the hosel is provided with a flattened area 18 (FIGS. 1 and 3) which is a smooth continuous extension of the flat surface of the club face 20. Flattened area 18 extends up the front portion of the hosel to a height in excess of the height of a golf ball 21 positioned on the ground and resting immediately in front of the heel 17 of the club face (FIG. 3). The flattened area 18 formed into the face of the hosel and bridging portion (the golf ball contacting surfaces) facing in essentially the same direction as the club face eliminates the possibility of driving a golf ball at an angle other than the intended line of flight due to the striking of a ball during a golf stroke in the area of the heel of the club and the point of juncture between the hosel and the club head, even when the golf ball is sitting in a relatively deep grass. Typically, such an error in a golf swing utilizing a prior art golf iron results in a "shank" with the ball being driven to the right of the intended line of flight by as much as 60° by a right-handed golfer, and to the left by a left-hander.

As is best illustrated in FIG. 5, the center line 22 of the club shaft 12 (as represented by the center line of the hosel 16) intersects the plane of the club face in the lower half thereof and in the preferred embodiment intersects the lowest quarter thereof, being situated close to or intersecting the leading edge 24 of the club face.

The point of juncture between club face 20 and the bridging portion-hosel is also a significant aspect of the present invention. The bridging portion 19 joins the club head at the upper top line or edge 23 of the heel end of club head at the corner nearest the shaft. As is seen in FIGS. 3 and 4, the club head 10 has a generally elongated configuration with top and bottom edges generally paralleling the axis of elongation. The bottom edge in golf club iron terminology is generally referred to as the sole of the club. This is in contrast with conventional club construction in which the hosel forms one side of the club face and extends along the length of that side of the club head. Such a prior art configuration resulted in an angular area or sharp corner of approximately 90° in the transition from club face to hosel. If the golf swing using such a club was made with the club face outside the intended line of flight of the ball, the golf ball would be struck by the "crook" between the hosel and the club face and would normally fly off at a considerable angle to the intended line of flight. With a club according to the present invention, the combined effect of elevating the point of juncture of hosel and club face and flattening the hosel and bridging portion in the area of juncture results in a virtually "shank-proof" golf iron since no golf ball contacting surface area of club face or shaft is presented to the golf ball which would tend to drive it off line. The further advantage of providing for the point of juncture of the hosel along the top edge of the club head is that the surface area of the club face is increased by approximately 10 to 15 percent.

The cross sectional view of FIG. 6 illustrates the broad sole 11 of the club and the concentration of weight in this area of the club head, making the club easier to use and tending to enable the player to move the club head smoothly through the ground at the moment of impact thereby providing a more natural and fluid follow through.

The utility of the club is further enhanced by flattening and thinning of the lower end of the hosel and the portion bridging the area between the club face and the hosel as is seen in FIGS. 2 and 5. In this area the hosel 16 and bridging portion 19 is a flat blade of generally rectangular or oblong cross-section. The thinning and flattening of the hosel together with its positioning and angulation relative to the club face, as is seen in FIG. 2, presents a clear and unobstructed view of the club face to the player as he addresses the ball before a shot. This clear and unobstructed view of the club face removes a psychological hazard, particularly in the case of relatively unskilled players, enabling better alignment of the club face at address of the ball and truer, more consistent shots on the "sweet spot" of the face than has heretofore been characteristic of golf irons.

What is claimed is:

1. A golf club iron including a head of a lofted, generally elongated configuration with an upper and a lower edge extending in the direction of elongation, said head having a club face, a hosel, and a flattened bridging portion integrally formed with and connecting the head and the hosel (portion), said bridging portion connecting to the club head at one side of said upper edge, the hosel having a flattened lower portion continuous with the flattened surface of the bridging portion extending a substantial distance up the hosel and a tubular upper portion, said flattened lower portion, flattened bridging portion and club face upper edge connecting portion defining a concave surface, the hosel being angled and oriented with respect to the club face such that an extension of the center line of the (club shaft) upper portion of the hosel intersects the plane defined by the club face in the lower quadrant adjacent the heel end of the club face.

2. A golf club according to claim 1 wherein the bridging portion and the hosel lower portion present in their golf ball contacting surfaces an essentially flat surface, said flat surface facing in the same direction as the club face and being continuous with the surface of the club face.

3. A golf club according to claim 1 wherein the flat surface on the hosel lower portion extends a distance along the hosel portion in the direction of the club shaft to a height in excess of the diameter of a golf ball measured along a line extending perpendicularly from a line defined by the sole of the club head and tangent to the heel of the golf club head.

4. A golf club according to claim 1 wherein the hosel portion is angled and oriented with respect to the club face such that an extension of the center line of the club shaft intersects a horizontal plane through the center of the club face in the region immediately adjacent the heel of the club and intersects the plane of the club face at a point below the line of intersection of said horizontal plane and the plane of the club face.

5. A golf club according to claim 1 wherein the flat surface on the hosel portion extends a distance along the hosel portion in the direction of the club shaft to a height in excess of the diameter of a golf ball measured along a line extending perpendicularly from a line defined by the sole of the club head and tangent to the heel of the golf club head.

6. A golf club according to claim 1 wherein the portion of the hosel integrally formed with the bridging portion is essentially oblong in cross-section, gradually tapering in the direction of the club shaft to a tubular configuration.

7. A golf club iron comprising an elongated head having a lofted club face, and upper and a lower edge extending in the direction of elongation, and a toe-side portion and a heel-side portion, a tubular hosel, and a flattened bridging portion integrally formed with and connecting the head and the hosel, said bridging portion connecting to the club head at the heel side of said upper edge and blending into said heel-side portion, the hosel having a generally cylindrical upper portion and a flattened lower portion, said flattened lower portion being continuous with the flattened surface of the bridging portion, said heel-side portion, flattened bridging portion and flattened lower portion defining a continuously concave surface facing in essentially the same direction as said club face, said flattened lower portion extending a substantial distance up the hosel, said hosel being angled and oriented with respect to the club face such that an extension of the center line of said upper portion intersects the plane defined by the club face in the lower quadrant adjacent said heel-side portion of the club face.

* * * * *